United States Patent [19]

Lerman

[11] Patent Number: 4,911,475

[45] Date of Patent: Mar. 27, 1990

[54] BOOK BINDING CONSTRUCTION

[76] Inventor: Harry H. Lerman, 524 Cross St., malden, Mass. 02148

[21] Appl. No.: 256,722

[22] Filed: Oct. 12, 1988

Related U.S. Application Data

[63] Continuation-in-part of Ser. No. 24,123, Mar. 10, 1987, abandoned.

[51] Int. Cl.[4] ..... B42D 5/00; B42C 9/00

[52] U.S. Cl. ..... 281/15.1; 281/21.1; 281/40; 281/36; 281/51; 412/6; 412/8

[58] Field of Search ..... 281/15.1, 21.1, 38, 281/40, 36, 51; 412/6, 8, 37

[56] References Cited

U.S. PATENT DOCUMENTS

| | | | |
|---|---|---|---|
| 2,277,265 | 3/1942 | Zahniser | 281/21.1 |
| 2,314,087 | 3/1943 | Heller | 281/21.1 X |
| 2,523,860 | 9/1950 | Budden | 412/8 X |
| 2,914,318 | 11/1959 | McGarvey et al. | 281/21.1 X |
| 3,570,071 | 3/1971 | Wardell | 281/21.1 X |
| 4,299,410 | 11/1981 | Jukola | 281/21.1 |
| 4,371,194 | 2/1983 | Wang et al. | 281/21.1 |
| 4,471,976 | 9/1984 | Giulie | 412/8 X |

FOREIGN PATENT DOCUMENTS

| | | | |
|---|---|---|---|
| 259474 | 10/1926 | United Kingdom | 281/40 |

*Primary Examiner*—Paul A. Bell
*Attorney, Agent, or Firm*—David Wolf

[57] ABSTRACT

A book having a binding wherein the pages thereof are bound together by two or more transverse segments of adhesive spaced apart by one or more segments devoid of adhesive or other means for restraining movement. The cover of the book is formed by a unitary sheet of flexible material having a spine section intermediate and intergral with the front and back cover sections. The front section of the cover is secured to the first page of the book block while the back section of the cover is secured to the last page of the book block thereby leaving the spine section of the cover unattached from the book block and spaced apart therefrom. Upon opening the book to a page, the spine of the book block bends in a concave manner and the segments along the spinal edge of the opened page which are devoid of adhesive, bow or wedge outward over the opposite page preventing the pages from turning and maintaining the book in a flat position.

10 Claims, 4 Drawing Sheets

BOOK BINDING CONSTRUCTION

RELATED APPLICATIONS

This is a continuation-in-part of application Ser. No. 024,123 filed on Mar. 10, 1987, now abandoned.

FIELD OF INVENTION

This invention relates to books and magazines and in particular, to an improved binding construction for paperback books and magazines The term paperback refers to soft-covered books as well as catalogs, booklets and similar paper-bound products.

BACKGROUND OF INVENTION

Some books are made with rigid spines. Others, usually paperback books, are typically manufactured by fastening a stack of pages, known as a book block, to a flexible cardboard or paper cover by gluing one edge of the book block to the spine of the cover with a flexible glue. Although the spines of such books are flexible, such books do not readily lie flat when opened, and therefore are often hard to maintain in a readable position. Attempts by the reader to overcome the tendancy of such books to close or pages to turn, by bending the spines often result in broken spines and a subsequent loss of pages from the book blocks. Books with unflexible spines are even less likely to lie flat when opened.

There are a number of patents which disclose book binding constructions. U.S. Pat. No. 2,523,860, issued Sept. 26, 1950 to Budden, disclosures an adhesive binding for books in which one of two or three adhesive layers which bind the spinal edge of the book block to the book cover has an intermittent pattern. In Budden, the entire surface of the spinal edge of the book block is completely covered with adhesive by either a preliminary adhesive coat or by the combination of the intermittent adhesive pattern and a subsequent adhesive coat (see column 4, lines 6–14, 19–34 and 35–50). In the construction exemplified by the Budden patent, the primary objective of the Applicant's invention, namely making the book lie flat when open, could not be achieved, was much as the Budden patent is directed to saving adhesive, providing greater resistance to shear forces, and decreasing resistance to rounding and backing of the book block with conventional machines.

U.S. Pat. No. 4,299,410, issued Nov. 10, 1981 to Jukola, discloses a soft-covered book binding in which a layer of gauze, cloth or crepe, fastened to the entire spine of the book block, binds the book block together while the soft book cover is fastened to only the first and last pages of the book block (column 1, lines 50–58). Thus, the Jukola patent does not address the primary objective of the present invention, namely making a book lie flat.

Other references that deal with book binding problems do not recognize the problems or the solutions with which the present invention is concerned including U.S. Pat. No. 2,914,318, issued Nov. 24, 1959 to McGarvey; 2,277,265, issued Mar. 24, 1942 to Zahniser; 4,471,976, issued Sept. 18, 1984 to Giulie; 4,371,194, issued Feb. 1, 1983 to Wang; and 3,570,071 issued Mar. 16, 1971 to Wardell.

SUMMARY OF INVENTION

The primary object of the present invention is a soft-covered book that lies flat when opened without pages turning on their own. This objective is achieved, in large measure, by the spine construction and a wedging action of the book's pages against one another. Upon opening the book or turning a page, glue free portions of the spinal edge of the open page flex or bow outward over the facing page in a wedging manner or interfering fit. This wedging action against the opposite page resists the tendency of the book to spring closed and forces the pages to lie flat.

DETAILED DESCRIPTION

Figure 1:
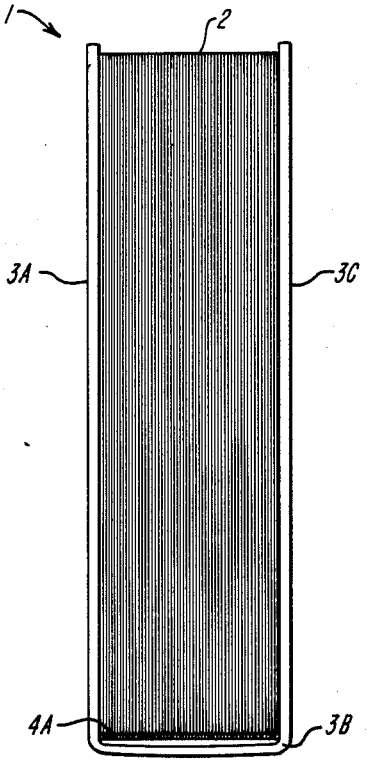
FIG. 1 is an end view of a closed book looking from one end of the spine with its spine unflexed.
Figure 2:
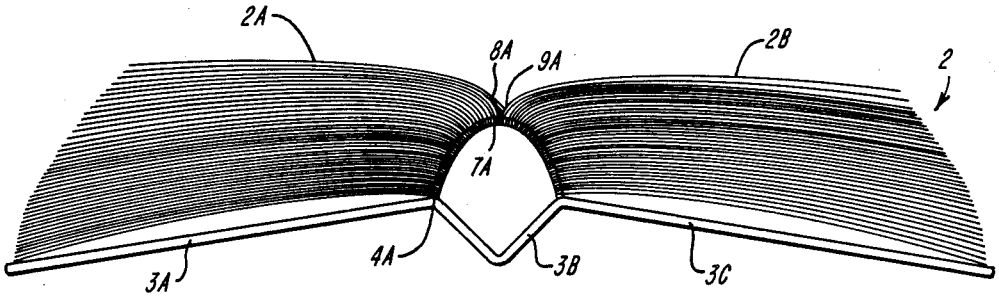
FIG. 2 is an enlarged end view of an open book with its spine flexed and the pages wedged open.
Figure 3:
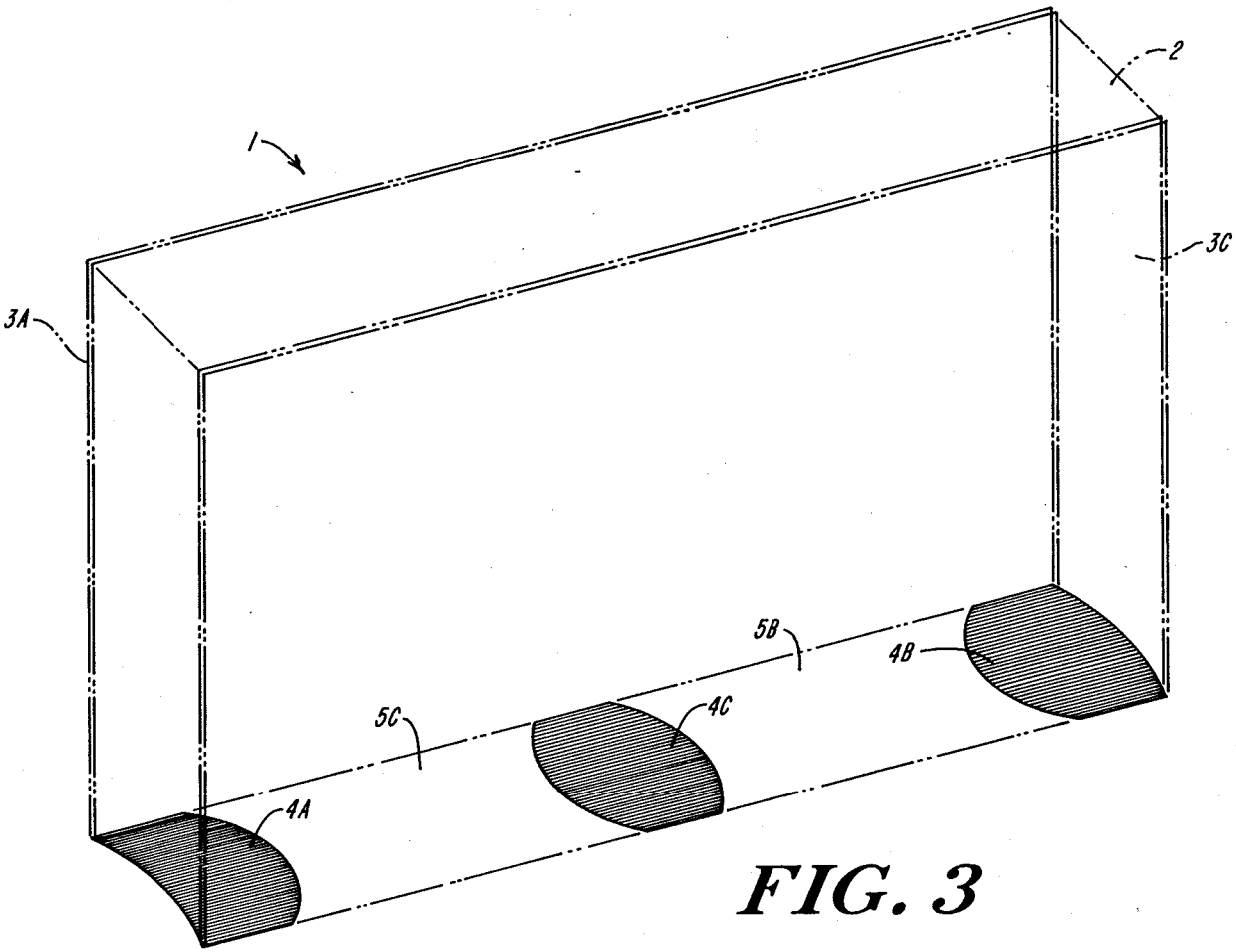
FIG. 3 is a perspective view showing typical locations of glued and unglued areas along the length of a book shown in dotted outline.

Referring now to the drawings, particularly FIGS. 1–3, there is shown a soft-covered paperback book 1. Book 1 is comprised of a book block comprising a stack of adjacent pages 2 bound together along one side. The cover 3 is preferably a unitary sheet of flexible material, such as thick paper or thin cardboard, that forms the front of cover 3A, spine section of the cover 3B and back cover 3C. A plurality of glue segments 4A, 4B, 4C (FIG. 3), extending transversely across one side of the book block at spaced intervals, secure the leaves together. The front cover 3A is secured to the first page of book block 2 along a spinal edge of the book block. Likewise, back cover 3C is secured to the last page of book block 2 along the other spinal edge of the book block. The spine section of the cover 3B is not attached to the book block 2 and is free to flex in a direction opposite the bending of the book block.

In the preferred embodiment of FIG. 3, transverse segments of binding glue 4A and 4B are located at the extreme ends of the book block. Between glue segments 4A and 4B, one or more additional glue segments 4C may be added. Between the binding glue segments are areas 5A and 5B that are void of glue or any other means of restraint.

The shape of the glue segments 4A, 4B and 4C affects the wedging action of the pages. In the preferred embodiment, these glue segments 4A, 4B and 4C have a concave shape. Empirical evaluation suggests that glue segments with concave shapes have improved wedging action.

When glue segments 4A–4C have concave shapes, the spine section 3B of the cover will assume more readily a concave shape across its width as illustrated in FIG. 1. This configuration will facilitate keeping the book open to selected pages when it rests on a flat surface.

In the preferred embodiment, the percentage of total glued areas on the side of the book block forming the spine should be between about 28% and 59% of the total spinal area for the most commonly used book paper. Within these percentages the larger the portion of glued area, the more static load the book pages will be able to withstand. However, with increased glue area, the spine becomes more rigid and page wedging action becomes more difficult to initiate. If there is too little glue over the total spine area, the pages may fall out, wrinkle and not wedge. Thus, to maintain a preferred flexibility and binding strength of proper page wedging, a total glued area along the spine of between 42% and 59% rather than the permissable range of 28% to 59% referred to above of the total spinal area is recommended.

The desired page wedging condition works best in books where the length of the glue segments 4A, 4B and 4C along the length of the spine are between about ½ inch and about 1 inch. The intermediate unglued segments along the spine should range from about 2" to 2 ¾" in length. In a preferred embodiment, the most efficient page wedging action results when three glue segments are used, one at each extreme end of the spine, and a center glue segment as shown in FIG. 3.

The actual shape of glue segments 4A–4C affects the uniformity of the page wedging action of pages throughout the book. The ratio of glued to unglued segments necessary for the desired page wedging action varies depending upon the page opened. The pages of the book closest to the front cover 3A and back cover 3C require smaller length glue segments 4A and 4C and greater length unglued segments 5A, 5B and 5C, while the center pages of the book require greater lengths of glued segments 5A, 5B and 5C to ensure the proper page wedging action Therefore as illustrated in FIG. 3 glue segments 4A–4C in the preferred embodiment have a concave shape or a shape which tapers to a maximum width at the center of the spine 6. Thus the concave shape of the glue segments along the spine insure more uniform page wedging throughout the book. In this embodiment, glue segments 4A and 4B have a length of approximately 6/8 of an inch along the sides of the book block, which length increases along an arc to a maximum of approximately ⅞ of an inch at the center of the book block. Center glue segment 4C is concaved at each end with a length of approximately ⅜ of and inch at the sides of the book block to a maximum of ⅝ of an inch at the center of the book block.

In an alternate embodiment, diamond shaped glue patterns may be used for similar uniform page wedging action. The dimensions of the diamond shaped center glue segment 4C are similar to the curved shaped glue segment 4C. However, the end diamond glue shapes 4A and 4B may have lengths of approximately ¾ inch at the sides of the book block which taper linearly to a point having a maximum thickness of approximately 1 inch at the center of the book block.

The characteristics of the glue comprising the glue segments 4A–4C affects the wedging action of the pages. The high temperature, quick setting glue used for binding most soft covered paperback books is considered adequate for the present invention. The speed and pressure of application as well as the viscosity of the glue should be adjusted to enable maximum absorbency by the paper of the book block 2. In the preferred embodiment, glue segments 4A, 4B and 4C should have a thicknesses of between 0.009 inch and 0.029 inch to facilitate a strong binding of the pages into an integral unit.

The thickness and stiffness of the leaves forming the book block 2 affects the wedging action of the pages against one another. In the preferred embodiment, a paper thickness for each leaf or page of approximately 0.0050 inch is recommended. Further, optimal page wedging action is obtained by using paper with a high radius of bend or stiffness characteristic. Stiff paper which is normally a disadvantage in conventional paperback and hardcover books is desirable in the present invention since pages made of stiffer paper exhibit a more pronounced bowing tendency and remain wedged against one another more easily. However, the invention will work adequately with commonly used paper having conventional stiffness found in paperback books ordinarily available today.

Figure 6A:
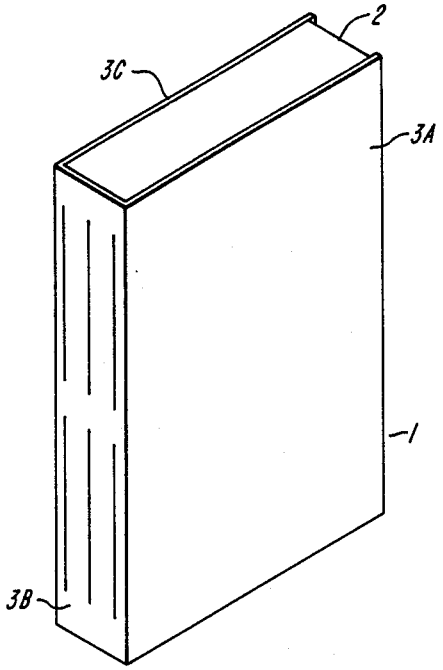
FIGS. 6A and 6B are perspective views of additional embodiments.
Figure 6B:
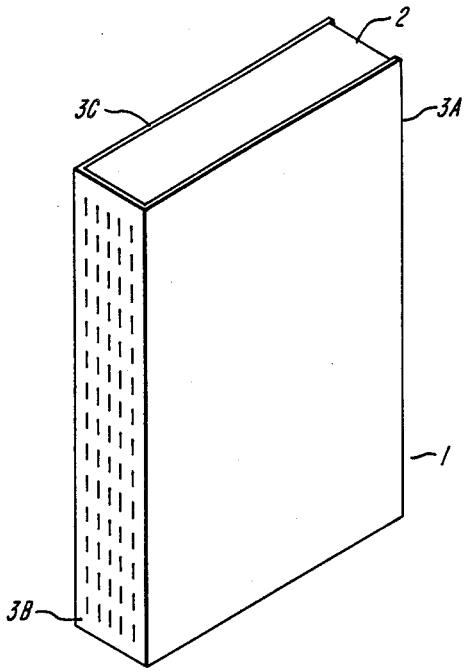

The spine section 3B of the cover, is free to flex between front cover 3A and back cover 3C and can be manipulated to further improve the page wedging action of book block 2. As illustrated in FIG. 6A, a pattern of vertical slits made in the spine section 3B of the cover facilitates creasing of the spine section 3B in a direction which is opposite to the creasing of the book block. Upon opening book 1, as the spine of book block 2 flexes into a concave shape, the slits in spine section 3B enable creasing and flexing of spine section 3B into a convex shape. This convex bending causes even sharper concave bending of book block 2 along the spine resulting in increased page wedging action at the opened pages. A dense pattern of serrations which perforate the cover section 3B, as shown in FIG. 6B, will likewise facilitate flexing of spine section 3B so as to enable a sharper bending of book block 2 and therefore increased page wedging action.

An intermediate front cover made of thick paper or thin cardboard may be secured between front cover 3A and the first page of book block 2 to facilitate a stronger attachment of cover 3 to book block 2. Likewise, an intermediate back cover may be secured between back cover 3C and the last page of book block 2.

Figure 5:
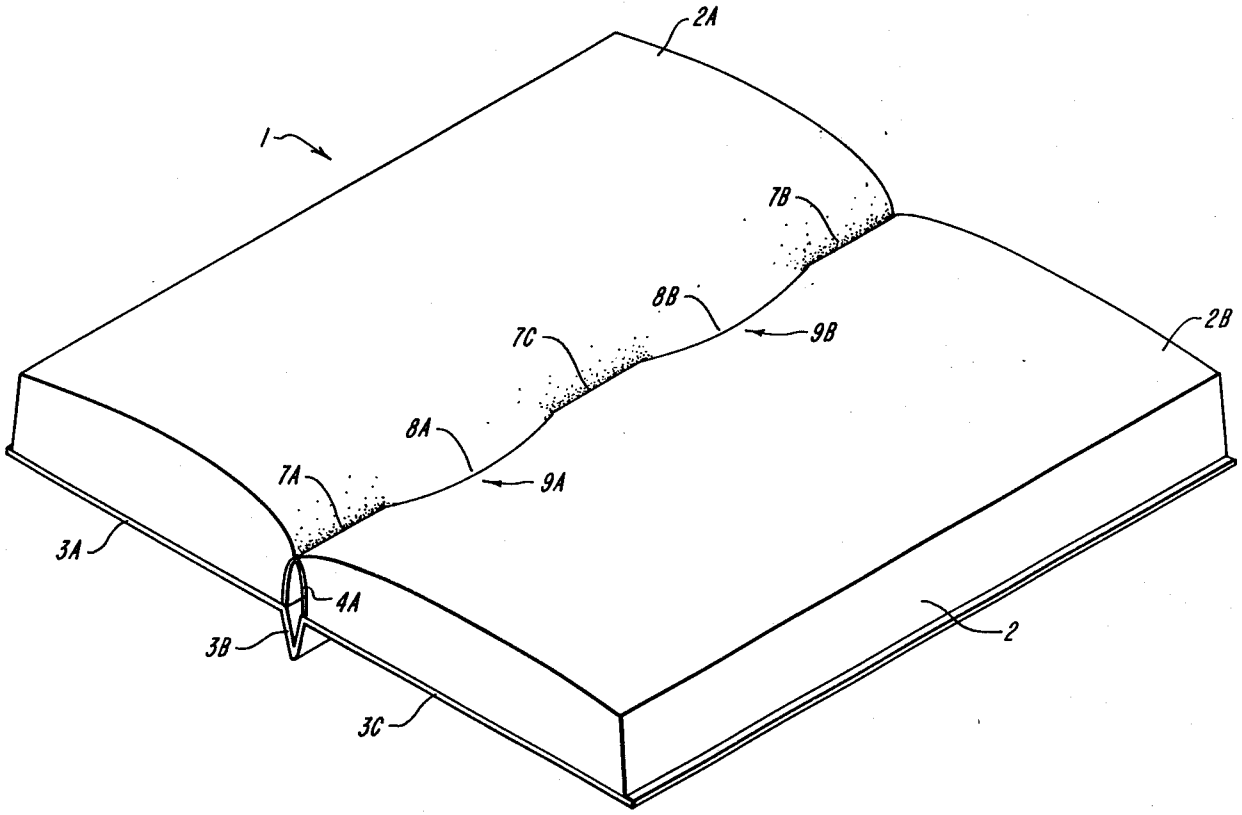
FIG. 5 is a perspective view of an open book illustrating the flexed spine and wedging action of one page against the other.
Figure 4:
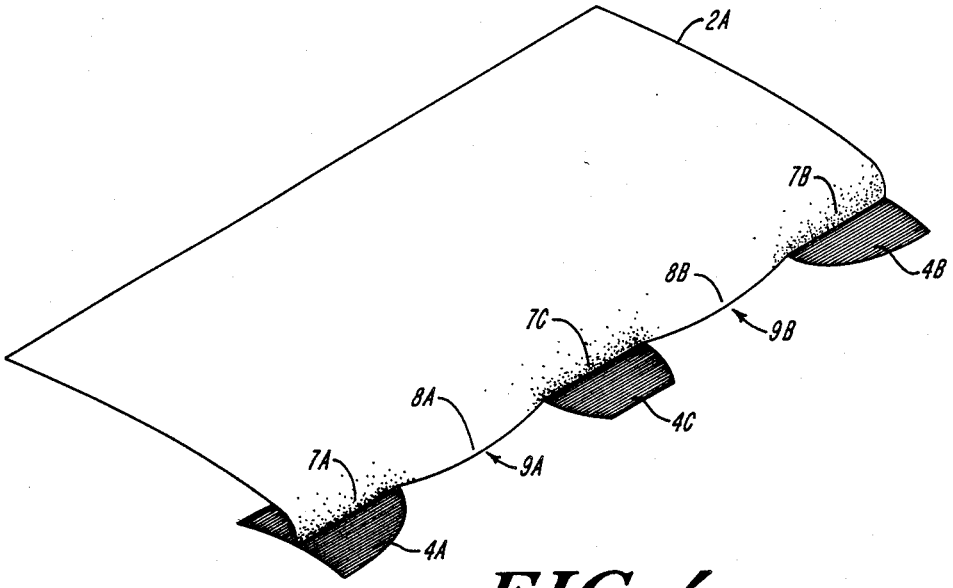
FIG. 4 is a perspective view of a bent page illustrating the relationship between the page edge, glue paths and areas void of glue.

Upon opening the book 1, as illustrated in FIGS. 2, 4 and 5, the book block 2 bends or creases at pages 2A and 2B to which the book is opened. Page 2A remains bound at locations 7A, 7B and 7C. However, the unrestrained or free segments of spinal edges of page 2A characterized by areas 8A and 8B bow outwardly respectively between glue joints 4A and 4B, and 4B and 4C, at locations 9A and 9B forming a series of wedges against facing page 2B. The engagement of the free edge segments or areas 8A and 8B against the surface of page 2B prevent both pages 2A and 2B from inadvertent turning unless positively turned. Upon positive closing book 1, the wedging action at locations 9A and 9B retracts as the spine section of the cover 3B and book block 2 return to their original state.

In view of the foregoing it will be noted the variations may be made without departing from the true spirit of the Applicants invention.

What is claimed is:

1. A book having a block of pages secured to a cover having a flexible spine, said block of pages formed as as integral unit by at least two transversely flexible segments of adhesive with an unbound segment therebetween, said adhesive segments extending across one side of said block thereby binding said pages together only at said side, means securing said block to said cover with said flexible spine aligned with and facing said one side, whereby the unbound segment of a first page to which the book is open bows outwardly over the facing page in an engaging and wedging manner.

2. A book binding as set forth in claim 1 wherein said cover is formed of a unitary sheet of flexible material having said flexible spine section intermediate and integral with the front and back sections of said cover.

3. A book binding as set forth in claim 2 wherein said means securing said block to said cover comprises adhesive securing the first page of said block to the front section of said cover, and securing the last page of said block to the back section of said cover, whereby said flexible spine section is unattached to said block and free to flex upon opening said book.

4. A book binding as set forth in claim 3 wherein said means securing said block to said cover further comprises an intermediate front cover secured intermediate the first page of said block and the front section of said cover, and an intermediate back cover secured intermediate the last page of said block and the back section of said cover, whereby said flexible spine section is unattached to said block and free to flex upon opening of said book.

5. A book binding as set forth in claim 2 wherein said spine section of said cover has a plurality of linear incisions extending along at least a portion of the length of said spine section.

6. A book binding as set forth in claim 2 wherein said spine section of said cover has a plurality of short vertical serrations which extend along at least a portion of the length of said spine section.

7. A book binding as set forth in claim 1 having said segments of adhesive at the upper and lower ends of said block of pages.

8. A book binding as set forth in claim 7 having a plurality of segments of adhesive intermediate said segments at said upper and lower ends of said block of pages and forming therebetween a plurality of said unbound segments.

9. A book binding as set forth in claim 7 wherein the edges of said glue segments have a curved shape.

10. A book binding as set forth in claim 7 wherein the edge of said glue segments taper linearly to a point having a maximum thickness at the center of said block of pages.

* * * * *